United States Patent [19]

Moertel

[11] 4,250,598

[45] Feb. 17, 1981

[54] WOVEN SLIDE FASTENER STRINGER WITH MOLDED FASTENING ELEMENTS

[75] Inventor: George B. Moertel, Conneautville, Pa.

[73] Assignee: Textron Inc., Providence, R.I.

[21] Appl. No.: 73,963

[22] Filed: Sep. 10, 1979

[51] Int. Cl.[3] ..... A44B 19/34

[52] U.S. Cl. ..... 24/205.16 R; 24/205.13 D

[58] Field of Search ..... 24/205.13 D, 205.12, 24/205.16 R

[56] References Cited

U.S. PATENT DOCUMENTS

| | | | |
|---|---|---|---|
| 3,328,857 | 7/1967 | Burbank | 24/205.13 D |
| 3,414,948 | 12/1968 | Cuckson et al. | 24/205.13 D |
| 3,696,473 | 10/1972 | Jones | 24/205.13 R X |
| 4,033,014 | 7/1977 | Manning | 24/205.16 R |
| 4,080,691 | 3/1978 | Moertel | 24/205.13 R X |
| 4,140,157 | 2/1979 | Scott | 24/205.13 R X |
| 4,171,556 | 10/1979 | Moertel | 24/205.13 DR |

*Primary Examiner*—Roy D. Frazier
*Assistant Examiner*—Peter A. Aschenbrenner
*Attorney, Agent, or Firm*—O'Brien & Marks

[57] ABSTRACT

A woven slide fastener stringer includes spaced coupling elements molded on spaced parallel connecting threads with reinforcing projections extending from respective leg portions of the coupling elements along upper connecting threads. The reinforcing projections have lower surfaces which are inclined relative to the connecting threads to produce substantially stronger reinforcing projections.

6 Claims, 19 Drawing Figures

WOVEN SLIDE FASTENER STRINGER WITH MOLDED FASTENING ELEMENTS

TECHNICAL FIELD

This invention relates to slide fasteners and particularly to woven stringers for slide fasteners having polymer coupling elements molded on spaced connecting threads with integral projections extending parallel the connecting threads to bear a substantial amount of crosswise forces applied by weft thread loops extending around the connecting threads.

BACKGROUND ART

The prior art, as exemplified in U.S. Pat. Nos. 3,328,857, 3,414,948, 3,445,915, 3,487,531, 3,490,111, 3,508,304, 3,696,473, 4,033,014 and 4,140,157, contains a number of slide fasteners employing polymer coupling elements molded on spaced connecting threads wherein the coupling elements are initially molded in a flat condition with the leg portions molded onto respective connecting threads and then the leg portions are folded together or toward each other. Such prior art coupling elements are attached to the edge of the tape either by threads such as stitching threads or warp threads passing over leg portions of the coupling elements or by threads such as weft threads passing around the connecting threads between the coupling elements. In such slide fasteners where the coupling elements trains are secured in the edge of the tape by looping the weft thread around connecting threads in a weaving process, the connecting threads are subject to being pulled from the leg portions due to crosswise forces on the slide fastener tapes. In my previous U.S. application Ser. No. 817,718 filed July 21, 1977, now Pat. No. 4,171,556 substantially improved coupling elements for such woven slide fasteners are disclosed wherein integrally molded reinforcing projections extend from leg portions of the coupling elements parallel to the connecting threads reinforcing the union of the connecting threads with the coupling elements. In coupling elements with reinforcing projections employing at least four spaced connecting threads, it has been previously suggested to position the reinforcing projections along the upper connecting threads to permit the lower connecting threads to have freedom for compression to releave stress on the upper connecting threads during bending of the coupling elements passing through a slider and to also improve flexibility of the slide fastener.

SUMMARY OF THE INVENTION

The invention is summarized in a woven stringer for a slide fastener including a plurality of spaced parallel connecting threads, a plurality of spaced polymer coupling elements each including a head portion and a pair of leg portions extending in generally the same direction from opposite sides of the head portion, the pair of leg portions of each coupling element having respective heels, the pairs of leg portions of the plurality of coupling elements being molded transversely on the respective connecting threads whereby the connecting threads and the coupling elements form a train of coupling elements, the coupling elements each having a plurality of integral reinforcing projections molded to respective upper threads of the plurality of connecting threads and extending from the respective leg portions along the respective upper connecting threads, the reinforcing projections only extending partially across spaces between adjacent pairs of the coupling elements leaving sections of the connecting threads free between each pair of adjacent coupling elements, a woven tape having a plurality of a warp threads and a weft thread interwoven with the warp threads, the weft thread including a plurality of loops of the weft thread on one edge of the tape extending around the connecting threads and the reinforcing projections between each respective adjacent pair of coupling elements to secure the train of coupling elements on the tape, the reinforcing projections each having an upper shelf which is disposed intermediate the respective head portion and the respective heel and which is disposed at a height about equal to a height of the respective upper connecting thread, each upper shelf engaging and supporting at least one of the plurality of loops between each respective adjacent pair of coupling elements, the reinforcing projections each having a lower surface which extends obliquely to the connecting threads, and each lower surface extending from a bottom portion of the respective leg portion upwardly and outwardly from the leg portion to an upper outer portion of the reinforcing projection.

An object of the invention is to construct a woven slide fastener stringer employing polymer coupling elements with leg portions molded on respective connecting threads with substantially improved reinforcing projections extending along upper connecting threads.

Another object of the invention is to substantially reduce the operating force required to move the slider to open and close a slide fastener having woven stringers with polymer coupling elements molded on pluralities of spaced connecting threads.

It is yet another object of the invention to position substantially stronger reinforcing projections spaced from heels of legs on molded coupling elements so that the heels may be welded together without welding of the reinforcing projections.

An advantage of the invention is that internal and external reinforcing cords may be eliminated to reduce the cost of a woven slide fastener stringer.

One feature of the invention is that reinforcing projections are located along the line containing points about which a train of coupling elements pivot in passing through a slider.

Other objects, advantages and features of the invention will be apparent from the following description of the preferred embodiment taken in conjunction with the accompanying drawings.

DESCRIPTION OF THE PREFERRED EMBODIMENTS

Figure 1:
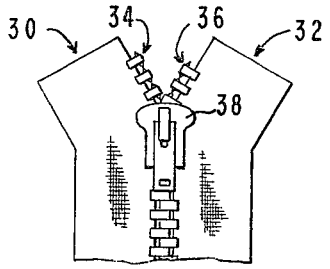
FIG. 1 is a plan view of a slide fastener constructed in accordance with the invention.

As shown in FIG. 1, a slide fastener with interlocking stringers in accordance with the invention includes a pair of planarly disposed support tapes indicated generally at 30 and 32 and a pair of trains of coupling elements indicated generally at 34 and 36 mounted on the respective inner edges of the tapes 30 and 32. A slider 38 is slidably mounted on the trains of coupling elements 34 and 36 for opening and closing the slide fastener. The tape 30 and the coupling elements 34 form a left stringer for the slide fastener while the tape 32 and coupling elements 36 form a right stringer for the slide fastener. The left and right stringers when interlocked together form a chain for the slide fastener. The right stringer is substantially a mirror image of the left stringer; thus for the sake of brevity only the left stringer is described in detail herein.

Figure 2:
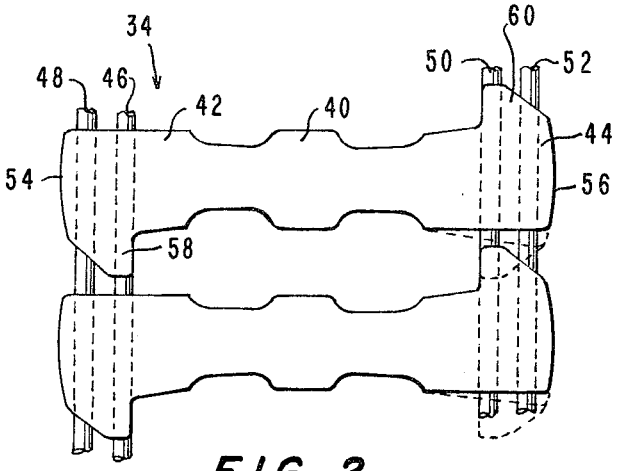
FIG. 2 is a plan view of a train of molded coupling elements in an unfolded condition and used in forming a stringer of the slide fastener of FIG. 1.
Figure 3:
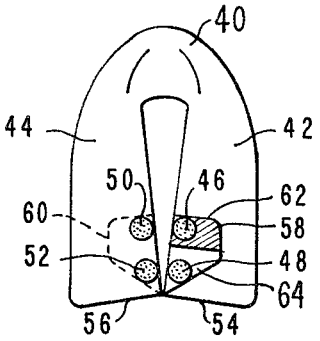
FIG. 3 is a cross-section view of the train of coupling elements of FIG. 2 but in a folded condition.
Figure 4:
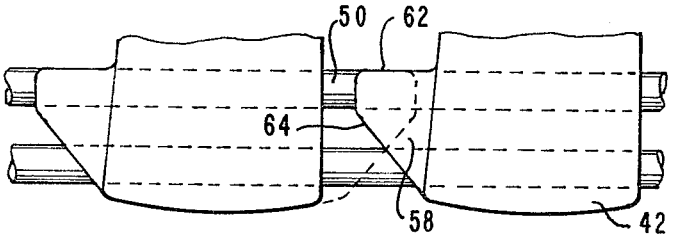
FIG. 4 is an elevation view of a broken-away bottom portion of the coupling element train of FIG. 3.
Figure 5:
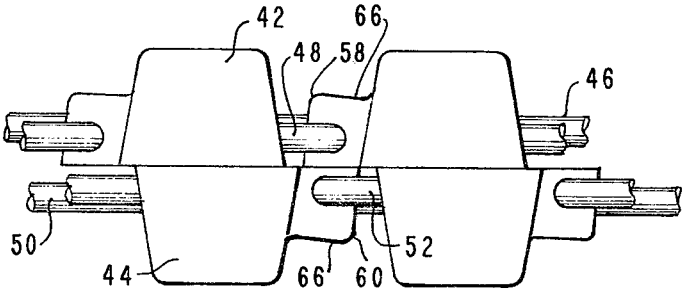
FIG. 5 is a bottom view of the coupling element train of FIGS. 3 and 4.

In manufacture of the left stringer for the slide fastener, the train of coupling elements 34 is initially formed in a flat condition as shown in FIG. 2 and is then folded as shown FIGS. 3, 4 and 5 prior to weaving of the tape 30. Each of the coupling elements 34 includes a head portion 40 and a pair of leg portions 42 and 44 extending from opposite sides of the head portion 40. After bending of the elements from the flat condition of FIG. 2 to the folded condition of FIGS. 3, 4 and 5, the leg portions 42 and 44 extend in generally the same direction from the head portions 40. The leg 42 is molded to a pair of spaced connecting threads 46 and 48, and similarly, the leg portion 44 is molded to a pair of spaced connecting threads 50 and 52; all of the connecting threads 46, 48, 50 and 52 are parallel. The train of coupling elements 14 are molded in a suitable injection molding apparatus from a molten polymer such as a thermoplastic resin so that the connecting threads 48 and 52 are disposed in the leg portions 42 and 44 adjacent to the respective heels 54 and 56 of the leg portions 42 and 44 while the connecting threads 46 and 50 are disposed spaced from the threads 48 and 52 intermediate the threads 48 and 52 and the head portion 40. When the coupling elements are folded, the connecting threads 46 and 50 form upper connecting threads while the connecting threads 48 and 52 form lower connecting threads. The heels 54 and 56 are formed so that the bottom surfaces of the legs 42 and 44 define a slight notch at the abutting or engaging edges of the heels for receiving and retaining the outermost warp thread or cord of the tape 30 as shown in FIG. 6.

The coupling elements 34 also each have a pair of integrally molded reinforcing projections 58 and 60 extending in opposite directions from each coupling element and from the respective leg portions 42 and 44 toward the respective adjacent coupling element. Each of the reinforcing projections 58 and 60 has an upper shelf or surface 62 which extends parallel to the connecting threads at about the same height as the upper connecting threads 46 and 50. A lower surface 64 of each of the reinforcing projections 58 and 60 extends at an oblique angle to the connecting threads 46, 48, 50 and 52 and extends from a bottom portion of the respective leg portion 42 or 44 upward and outward from the respective leg portion to an outer upper portion of the respective reinforcing projection 58 or 60. In the example of FIGS. 3, 4 and 5, this lower surface 62 extends from the respective heel 54 or 56 to the outer end of the projection 62 at a point below the upper connecting threads 46 and 48 but substantially above the bottom portions of the legs 42 and 44. The projections 58 and 60 each have an outer lateral surface 66 which extends from a point adjacent the respective leg portion 44 laterally outward toward the end of the reinforcing projection 58 and 60 to form a thread retaining notch or concavity on the outer lateral surface of each projection. For example, an outward inclination of about 5° on the surface 66 forms a suitable retaining concavity. The reinforcing projections 58 and 60 are sufficiently long so that end portions of projections 58 and 60, from the corresponding leg portions 42 and 44 of each adjacent pair of coupling elements overlap one another. The length of the projections 58 and 60 and the angle that the surface 66 inclines outwardly are selected to be sufficient to retain loops of weft thread on the projections 58 and 60.

Figure 6:
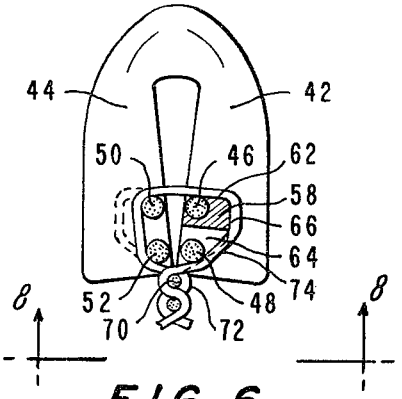
FIG. 6 is an enlarged cross-section view of a broken-away portion of one stringer of the slide fastener of FIG. 1.
Figure 7:
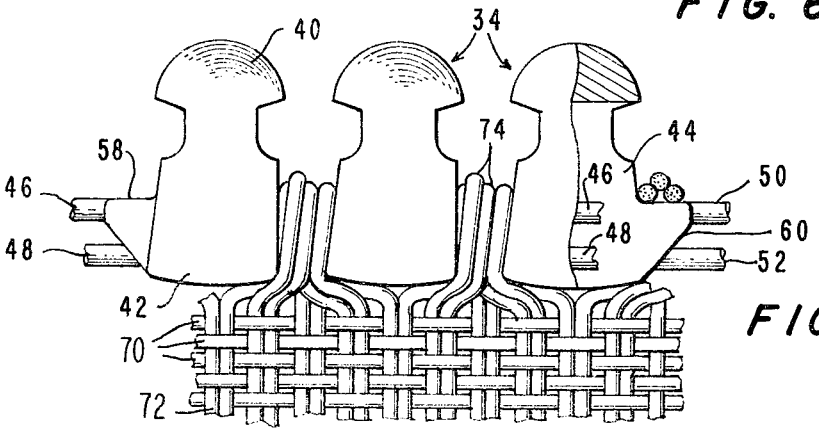
FIG. 7 is a plan view of the stringer portion of FIG. 6.

The tape 30, as shown in FIGS. 6 and 7, includes a plurality of warp threads 70 interwoven with a weft thread 72 which has a plurality of loops 74 on the edge of the tape extending around the connecting threads 46, 48, 50 and 52 between each adjacent pair of coupling elements 34 to secure the train of coupling elements 34 on the edge of the tape 30. Weaving of the weft thread 72 with the warp threads 70 and the train of coupling elements 34 is performed on a conventional slide fastener stringer weaving apparatus.

Figure 8:
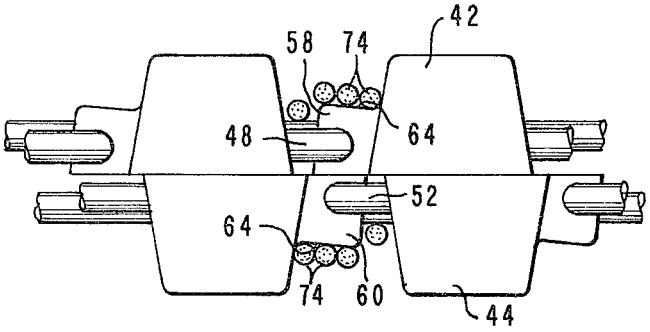
FIG. 8 is a cross-section view taken at line 8-8 in FIG. 6.

The present reinforcing projections have substantially improved or greater strength over previous reinforcements suggested for extending along the upper connecting threads and has substantially the same or greater reduction in failure of the union between the coupling elements in connecting threads as well as increased flexibility and ease of operation. By making the lower surface 64 to extend oblique to the connecting threads and to extend upwardly and outwardly from the bottom portions of the coupling element legs, the resulting projections are substantially stronger against cross-wise forces exerted on the projections by the loops of weft thread. The outwardly projecting angles of the lateral sides 66 as shown in FIG. 8 insures that at least one of the loops 74 of weft thread are retained upon each of the projections 58 or 60 between each pair of coupling elements; the outwardly inclined surfaces 66 prevent the weft thread loops 74 from slipping from the reinforcing projections onto the connecting threads thus insuring that the reinforcing projections bear a substantial portion of the forces from the weft thread loops.

Figure 9:
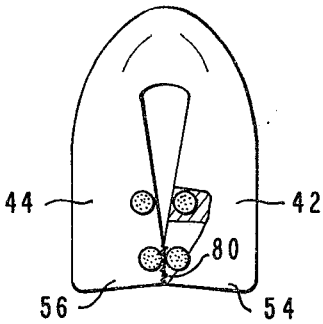
FIG. 9 is a cross-sectional view similar to FIG. 3 of a variation of the train of coupling elements in accordance of the invention.
Figure 10:
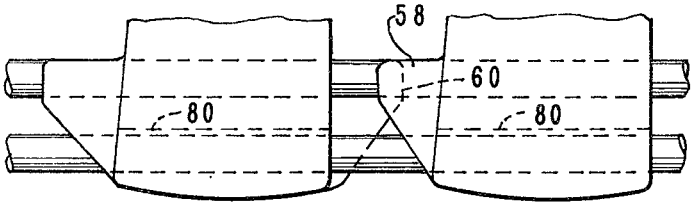
FIG. 10 is an elevation view of a broken-away bottom portion of the coupling element train of FIG. 9.

In a variation of the train of coupling elements as shown in FIG. 9 and 10, the lower portions of the coupling element legs 42 and 44 of each coupling element are welded together at 80 adjacent to the heels 54 and 56. Such welding is performed by passing the train of coupling elements through an ultrasonic mechanism or other welding mechanism during folding of the legs 42 and 40 together. As shown in FIG. 10, the projections 48 and 50 are formed so that their overlapping portions are above the line of the welds 80. This insures that the projections 58 and 60 are not welded together which would result in a decrease in ease of operation of the slider.

Figure 11:
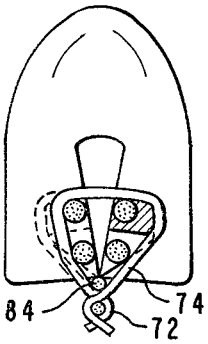
FIG. 11 is a cross-section view of a broken-away portion of a modified slide fastener stringer in accordance with the invention.

A modification of the train of coupling elements is illustrated in FIG. 11. In the embodiment of FIG. 6, the weft thread 72 crosses between the outermost warp thread 70 on the inner edge of the tape 30 with the loop 74 extending only around the connecting threads and reinforcing projections whereas in the modification of FIG. 11, the outermost warp thread 84 is shown included within the loop 74 to secure the warp thread 84 in abutment against the heels of the coupling elements within the V-shaped notch formed by the heel surfaces of the leg portions.

Figure 12:
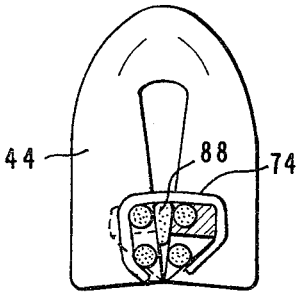
FIG. 12 is a cross-section view of a broken-away portion of a second modification of the slide fastener stringer in accordance with the invention.

In a second modification illustrated in FIG. 12, an invested cord 88 is positioned between the inside surfaces of the leg portions 42 and 44 so that the loop 74 also passes around the invested cord 82.

Figure 13:
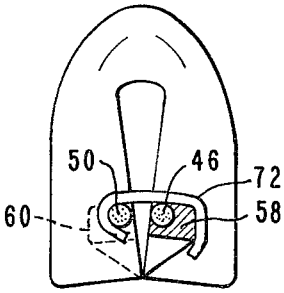
FIG. 13 is a cross-section view of a broken-away portion of a third modification of the slide fastener stringer in accordance with the invention.
Figure 14:
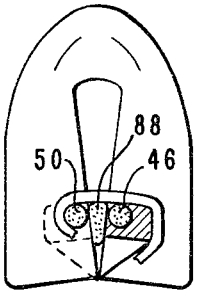
FIG. 14 is a cross-section view of a broken-away portion of a fourth modification of the slide fastener stringer in accordance with the invention.

In third and fourth modifications shown in FIGS. 13 and 14, respectively, the lower connecting threads are eliminated leaving only the upper connecting threads 46 and 50. By eliminating the lower connecting threads, a saving in cost can be achieved. The overlapping end portions of the reinforcing projections provide stability to the train of coupling elements to overcome any loss of stability resulting from elimination of the lower connecting threads. Increased ease of operation and flexibility also result from elimination of the lower connecting threads.

Figure 15:
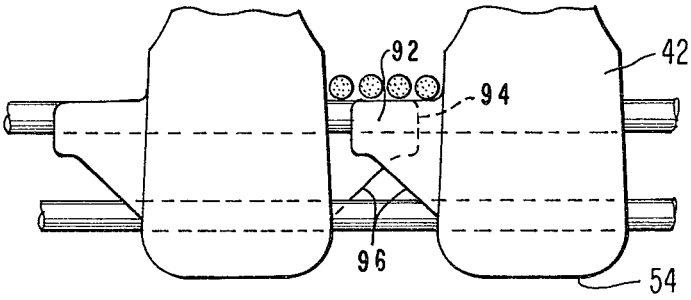
FIG. 15 is a side view of a broken-away bottom portion of a train of coupling elements for forming another variation of the slide fastener stringer in accordance with the invention.
Figure 16:
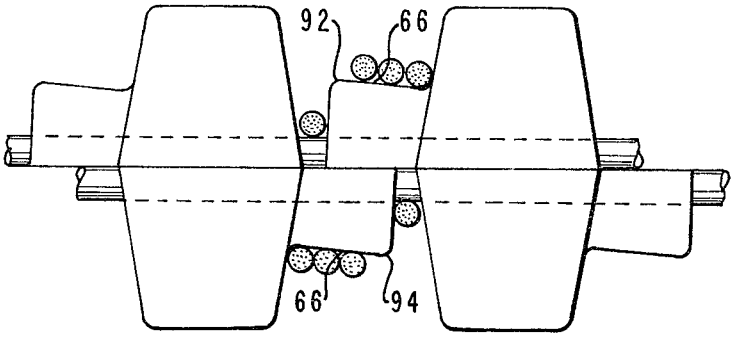
FIG. 16 is a bottom view of the coupling element train of FIG. 15.

The reinforcing projections 58 and 60 can have variations in shape as illustrated by projections 92 and 94 in a variation of the coupling element train in FIGS. 15 and 16. Lower surfaces 96 of the projections 92 and 94 extend upward and outward from a point on the bottom portion of the legs 42 and 44 spaced from the heels 54 and 56 to the upper outer portion of the projections 92 and 94. Also the upper portions of the surfaces 64 flare outwardly at the upper ends thereof. The projections 92 and 94 of the coupling element train in FIGS. 15 and 16 have less strength then the projections of FIGS. 4 and 5 but have substantially greater strength than the previously suggested projections on the upper connecting threads.

Figure 17:
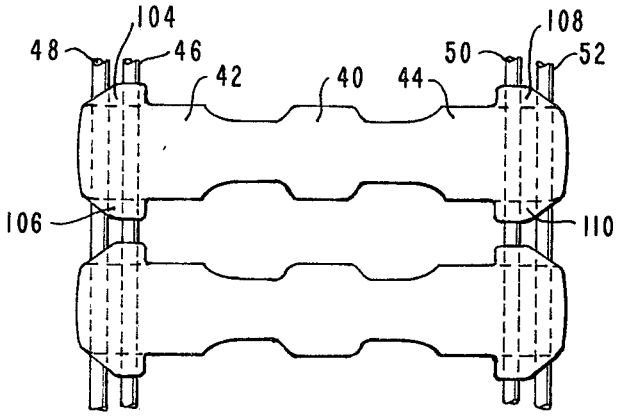
FIG. 17 is a plan view of a coupling element train in an unfolded condition for forming still another variation of the slide fastener stringer in accordance with the invention.
Figure 18:
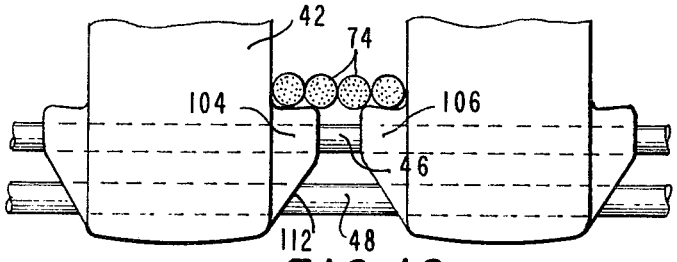
FIG. 18 is a side view of a broken-away portion of a slide fastener stringer employing the coupling element train of FIG. 17.
Figure 19:
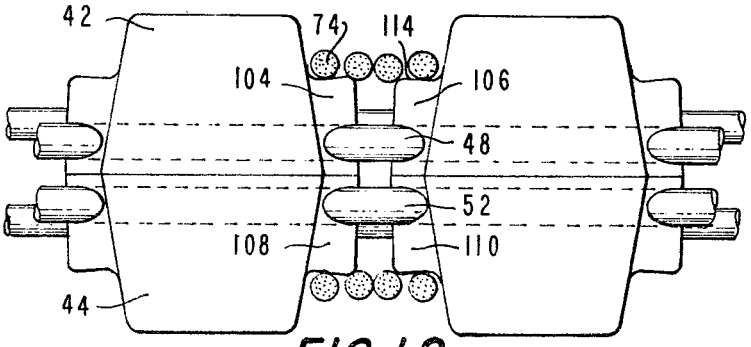
FIG. 19 is a bottom view of the broken-away stringer portion of FIG. 18.

In still another modification shown in FIGS. 17, 18, and 19, short reinforcing projections 104 and 106 extend from the leg portion 42 on opposite sides thereof along the connecting thread 46 and short reinforcing projections 108 and 110 extend from the leg portion 44 from opposite sides thereof along the connecting thread 50. The reinforcing projections 104, 106, 108 and 110 extend toward the respective adjacent leg portion of the adjacent coupling element less than half the distance between coupling elements leaving a short segment of the upper connecting threads 46 and 50 exposed to permit bending and flexibility of the train of coupling elements. The projections 104, 106, 108 and 110 have bottom surfaces 112 which are oblique to the connecting threads 46, 48, 50 and 52 as shown in FIG. 18 and which extend from the lower portion of the legs 42 and 44 upward and outward away from the leg portions to the outer end portions of the projections 104, 106, 108 and 110. As shown in FIG. 19, lateral outer surfaces 114 are formed on the projections 104, 106, 108, and 110 and extend outwardly to form concavities or recesses to retain at least one of the weft thread loops 74 thereon. The oblique bottom surfaces 112 provide the increased strength for the projections 104, 106, 108, and 110 in the same manner as the sloping bottom surfaces 64 provide increased strength to the reinforcing projections 58 and 60 of FIGS. 4–8. Also the outward protrusion or extension of the lateral surfaces 114 served to retain at least one weft thread loop 74 on each projection 104, 106, 108 and 110 to insure that a substantial portion of the cross-wise force of the slide fastener is applied to the reinforcing projections.

Since many variations, modifications and changes in detail can be made to the above described embodiments, it is intended that all matter in the foregoing description and shown in the accompanying drawings be interpreted as illustrative and not in a limiting sense.

What is claimed is:

1. A woven stringer for a slide fastener comprising a plurality of spaced parallel connecting threads, a plurality of spaced polymer coupling elements each including a head portion and a pair of leg portions extending in generally the same direction from opposite sides of the head portion, said pair of leg portions of each coupling element having respective heels, said pairs of leg portions of the plurality of coupling elements being molded transversely on the respective connecting threads whereby said connecting threads and said coupling elements form a train of coupling elements, said coupling elements each having a plurality of integral reinforcing projections molded to respective upper threads of said plurality of connecting threads and extending from the respective leg portions along the respective upper threads, said reinforcing projections only extending partially across spaces between adjacent pairs of the coupling elements leaving sections of said connecting threads free between each pair of adjacent coupling elements, a woven tape having a plurality of warp threads and a weft thread interwoven with the warp threads, said weft thread including a plurality of loops of the weft thread on one edge of the tape extending around the connecting threads and the reinforcing projections between each respective adjacent pair of coupling elements to secure the train of coupling elements on the tape, said reinforcing projections each having an upper shelf which is disposed intermediate the respective head portion and the respective heel and which is disposed at a height about equal to a height of the respective upper connecting thread, each upper shelf engaging and supporting at least one of the plurality of loops between each respective adjacent pair of coupling elements, said reinforcing projections each having a lower surface which extends obliquely to the connecting threads, and each lower surface extending from a bottom portion of the respective leg portion upwardly and outwardly from the leg portion to an upper outer portion of the reinforcing projection.

2. A woven stringer is claimed in claim 1 wherein the plurality of integral reinforcing projections on each coupling element comprise two reinforcing projections extending from the respective leg portions in opposite directions from the coupling element, and said two reinforcing projections extend more than halfway across the respective spaces between coupling elements and have end portions which overlap reinforcing projections from the adjacent coupling elements.

3. A woven stringer has claimed in claim 1 wherein said reinforcing projections on each coupling element comprise four reinforcing projections, two of the four reinforcing projections extending from each respective leg portion in opposite directions.

4. A woven stringer as claimed in claim 1, 2 or 3 wherein said reinforcing projections also include an outer lateral surface which extends at an angle outwardly away from the connecting threads to form a concavity retaining at least one of the weft thread loops on each of the projections.

5. A woven stringer as claimed in claim 1, 2, or 3 wherein said heels of each pair of leg portions abut and form a notch retaining a warp thread on the inner edge of the tape.

6. A woven stringer as claimed in claim 1, 2 or 3 wherein said reinforcing projections also include an outer lateral surface which is inclined at an angle of about 5° outwardly away from the connecting threads to form a concavity retaining at least one of the weft thread loops on each of the projections.

* * * * *